US005865241A

United States Patent [19]

Bishenden et al.

[11] Patent Number: 5,865,241

[45] Date of Patent: Feb. 2, 1999

[54] DIE CASTING MACHINE WITH PRECISELY POSITIONABLE OBLIQUELY MOVING DIE CORE PIECES

[75] Inventors: Warren J. Bishenden; Kevin W. Hollingworth, both of Newmarket, Canada

[73] Assignee: Exco Technologies Limited, Ontario, Canada

[21] Appl. No.: 833,708

[22] Filed: Apr. 9, 1997

[51] Int. Cl.[6] ..... B22D 17/26

[52] U.S. Cl. ..... 164/137; 164/341; 164/343; 164/347; 425/451.9; 425/468; 425/577; 425/595

[58] Field of Search ..... 164/137, 341, 164/343, 347; 425/451.9, 468, 577, 595, DIG. 10, DIG. 221

[56] References Cited

U.S. PATENT DOCUMENTS

| | | | |
|---|---|---|---|
| 3,165,796 | 1/1965 | McDonald . | |
| 3,433,292 | 3/1969 | McDonald | 164/343 |
| 3,596,708 | 8/1971 | Lapin | 164/343 |
| 3,905,740 | 9/1975 | Lovejoy | 425/438 |
| 4,073,609 | 2/1978 | Petrenchik | 425/442 |
| 4,206,799 | 6/1980 | McDonald | 164/341 |
| 4,362,291 | 12/1982 | Fuke et al. | 249/144 |
| 4,502,660 | 3/1985 | Luther et al. | 249/144 |
| 4,592,405 | 6/1986 | Allen | 164/120 |
| 4,641,701 | 2/1987 | Yamamoto | 164/90 |
| 4,678,158 | 7/1987 | Brock | 249/161 |
| 4,815,518 | 3/1989 | Sulprizo | 164/412 |
| 4,881,891 | 11/1989 | Luther | 425/556 |
| 4,919,189 | 4/1990 | Sato et al. | 164/137 |
| 4,938,679 | 7/1990 | Pietrorazio | 425/437 |
| 5,073,326 | 12/1991 | Craves et al. | 264/278 |
| 5,111,873 | 5/1992 | Kordovski et al. | 164/312 |
| 5,204,127 | 4/1993 | Prusha | 425/544 |
| 5,246,059 | 9/1993 | Sulprizio | 164/343 |
| 5,310,331 | 5/1994 | Wakebe et al. | 425/139 |
| 5,338,171 | 8/1994 | Hayakawa et al. | 425/138 |
| 5,353,682 | 10/1994 | Sulprizo | 91/395 |
| 5,361,823 | 11/1994 | Kuhn et al. | 164/9 |
| 5,365,997 | 11/1994 | Helgesen et al. | 164/103 |
| 5,422,059 | 6/1995 | Hettinga | 264/328.1 |
| 5,429,175 | 7/1995 | Thieman et al. | 164/312 |
| 5,551,864 | 9/1996 | Boskovic | 425/556 |
| 5,587,189 | 12/1996 | Niimi | 425/577 |
| 5,605,187 | 2/1997 | Perrella | 164/342 |
| 5,607,006 | 3/1997 | Koch | 164/112 |
| 5,638,888 | 6/1997 | Perrella | 164/312 |
| 5,701,947 | 12/1997 | Bishenden | 164/341 |

FOREIGN PATENT DOCUMENTS

| | | | |
|---|---|---|---|
| 1-232004 | 9/1989 | Japan | 164/341 |
| 2-37955 | 2/1990 | Japan | 164/340 |

*Primary Examiner*—Patrick Ryan
*Assistant Examiner*—I. H. Lin
*Attorney, Agent, or Firm*—David P. Gordon; David S. Jacobson; Thomas A. Gallagher

[57] ABSTRACT

A die casting machine has obliquely slidable die core pieces in an ejector holder block. The ejector holder block may be drawn away from the stationary die half into abutment with an ejection box by linear actuators; complementary male and female surfaces on the ejector holder block and ejection box precisely locate the ejector holder block with respect to the ejection box when the two are in abutment. The ejection box and mated ejector holder block may then be moved into abutment with the stationary die half to complete a die cavity.

12 Claims, 5 Drawing Sheets

DIE CASTING MACHINE WITH PRECISELY POSITIONABLE OBLIQUELY MOVING DIE CORE PIECES

FIELD OF THE INVENTION

This invention relates to a die casting machine and to a method for forming a die cavity.

BACKGROUND OF THE INVENTION

U.S. Pat. No. 4,206,799 which issued Jun. 10, 1980 to McDonald discloses a die casting machine having a stationary die half and an ejector holder block with an ejection box mounted one behind the other for movement toward and away from the stationary die half. There is a lost motion connection between the ejection box and the ejector holder block. Die core pieces are slidably received in the ejector holder block at an acute angle to the direction of movement of the holder block. Cylinders may extend the die core pieces toward the stationary die half. A hydraulic cylinder may push the ejection box toward the stationary die half after the die core pieces have been moved to their extended position. Once the ejection box is pushed into abutment with the ejector holder block, further movement of the ejecting box will push the ejector holder block along with the ejection box. In this way, the ejector holder block is moved into abutment with the stationary die half thereby forming a die cavity between the stationary die half and ejector holder block. The abutment of the ejection box with the ejector holder block provides an abutment for the rearward end of the die core pieces to lock these in their extended position. When the ejection box is moved away from the stationary die half, initially the ejector holder block remains stationary due to the lost motion connection. However, once the extremity of the lost motion connection is reached, further movement of the ejection box away from the ejector holder block causes the ejector holder block to move with the ejection box. The separation between the ejector holder block and the ejection box allows withdrawal of the die core pieces.

The tolerances of products cast with the die cast machine of this patent may be greater than desirable.

This invention seeks to overcome drawbacks of known die casting machines.

SUMMARY OF THE INVENTION

According to this invention, here is provided a mold for die casting machine comprising: a stationary die half; an ejector holder block mounted for movement forwardly toward and rearwardly away from said stationary die half such that said ejector holder block may be moved forwardly to a closed position forming, with said stationary half, a die cavity; at least one core piece slidably mounted in the ejector holder block for movement in a direction making an acute angle to the direction of movement of the ejector holder block between an extended position and a retracted position such that when said ejector holder block is in said closed position and said at least one die core piece is in said extended position, said die cavity is further defined; a moveable ejection box mounted rearwardly of said ejector holder block for movement forwardly toward and rearwardly away from said stationary die half; a rearward face of said ejector holder block and a forward face of said ejection box having complementary male and female locating surfaces for precisely locating said ejector holder block with respect to said ejection box when said ejector holder block is in abutment with said ejection box; an actuator for moving said ejector holder block rearwardly into abutment with each ejection box prior to movement of said ejection box forwardly toward said stationary die half.

In accordance with another aspect of the invention, there is provided a method for forming a die cavity, comprising the steps of: for each of at lest one die core piece received by an ejector holder block at acute angle to a first direction, moving said each die core piece to an extended position; moving said ejector holder block, in said first direction, toward an ejection box such that complementary male and female surfaces on said ejector holder block and said ejection box mate to precisely locate said ejector holder block with respect to said ejection box; moving said ejector holder block and said mated ejection box in a second direction opposite said first direction toward a stationary die half to a die closed position whereat said stationary die half, said ejector holder block and said at least one die core piece form a die cavity.

BRIEF DESCRIPTION OF THE DRAWINGS

In the figures which illustrate an example embodiment of the invention.

DETAILED DESCRIPTION OF THE PREFERRED EMBODIMENTS

Figure 1:
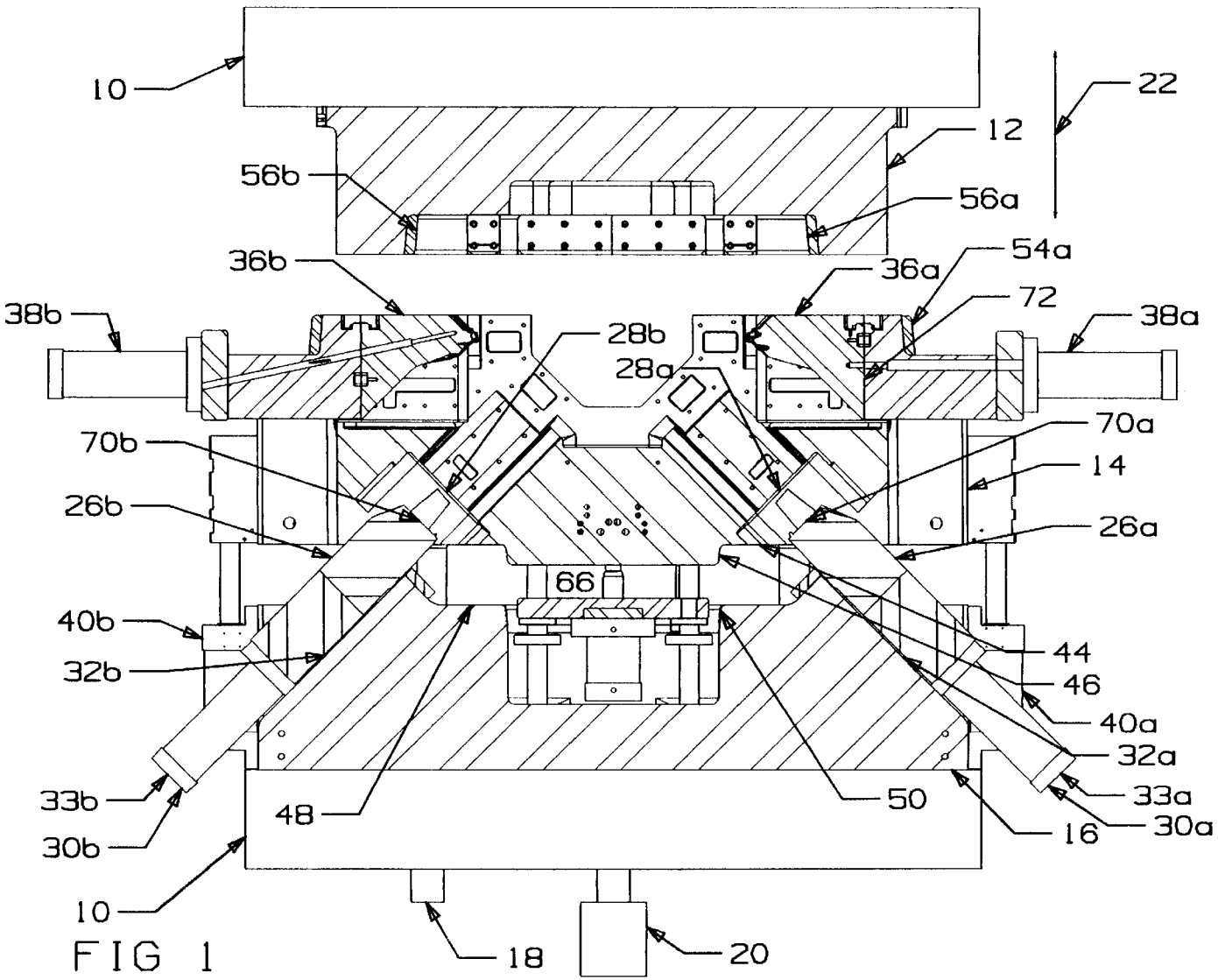
FIG. 1 is a top schematic view of the die casting machine made in accordance with this invention.

The exemplary die casting machine described in conjunction with the figures is adapted to cast V-6 automobile cylinder blocks. Turning to FIG. 1, the die casting machine is illustrated generally at 10 and comprises a stationary die half 12, an ejector holder block 14, and an ejection box 16. An actuator in the nature of double acting hydraulic cylinder 20 is joined to the ejection box 16 so as to be able to move the ejection box in a linear direction indicated at 22 forwardly toward or rearwardly away from stationary die half 12. Stop block 18 limits rearward movement of the ejection box. A pair of obliquely mounted die core pieces 26*a*, 26*b* with die cavity forming ends 70*a*, 70*b* are slidably received within channels 28*a*, 28*b*, respectively, in the ejector holder block so as to be slidable in a direction making an acute angle with direction 22. Double acting hydraulic cylinders 30*a* and 30*b* extend through wide slots 32*a*, 32*b* in ejection box 16 and are threaded to die core pieces 26*a*, 26*b*, respectively. The head 33*a*, 33*b* of each cylinder 30*a*, 30*b* is rigidly connected to the ejector holder block (connection not shown). Die core pieces 36*a* and 36*b* are slidably mounted to the forward face 72 of ejector holder block 14 for movement in a direction transverse to direction 22 under the urging of double acting hydraulic cylinders 38*a*, 38*b*. Double acting hydraulic cylinders 40*a*, 40*b* are mounted between the ejector holder block and the ejection box for drawing the ejector holder block toward the ejection box or for pushing the ejector holder block away from the ejection box. The rearward face 44 of the ejector holder block has a tapered male surface 46 and the forward face 48 of the ejection box has a complementary tapered female surface 50. The forward side of each of die core pieces 36*a* and 36*b* has a notch 54*a*, 54*b* sized to receive bulbs 56*a* and 56*b* protruding from the stationary die half.

Figure 2:
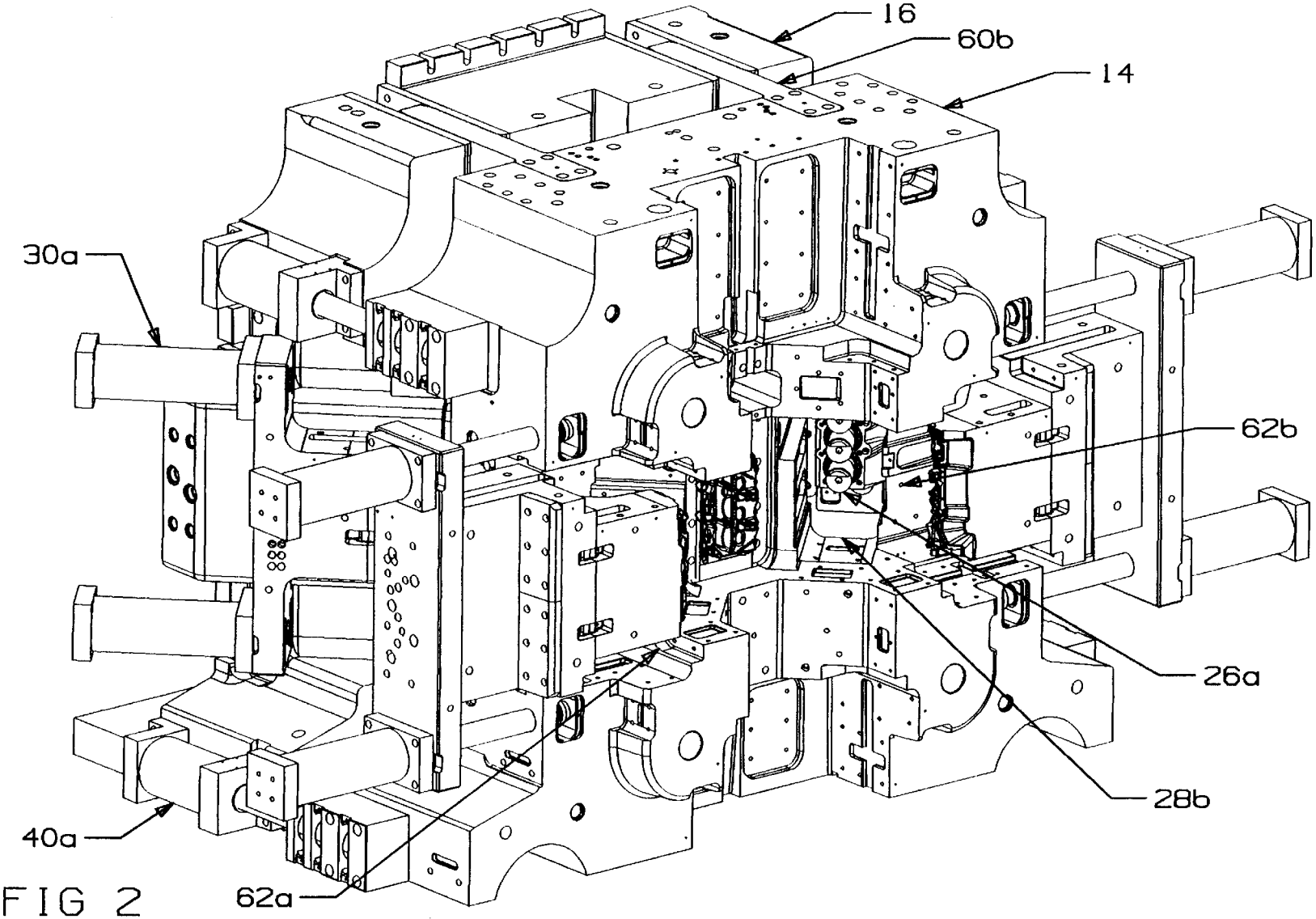
FIG. 2 is a perspective view of a portion of the die casting machine of FIG. 1.

As seen in FIG. 2, guides 60*a*, 60*b* are also provided between ejector holder block 14 and ejection box 16. In FIG. 2, die core pieces 26*b*, which would be received in channel 28*b*, are not shown. Neither are die core pieces 54*a*, 54*b*, however, these would be received by notches 62*a*, 62*b*, respectively.

The operation of the die casting machine 10 is now described assuming that the machine is initially in the position illustrated in FIG. 1. In the FIG. 1 position, there is a gap 66 between the ejector holder block 14 and the ejection box 16 which permits access to the interface between the hydraulic cylinders 30*a*, 30*b* and their respective die core pieces 26*a*, 26*b*. This allows the removal of each hydraulic cylinder from its die core piece to permit exchange of the die core pieces 26*a*, 26*b*.

Figure 3:
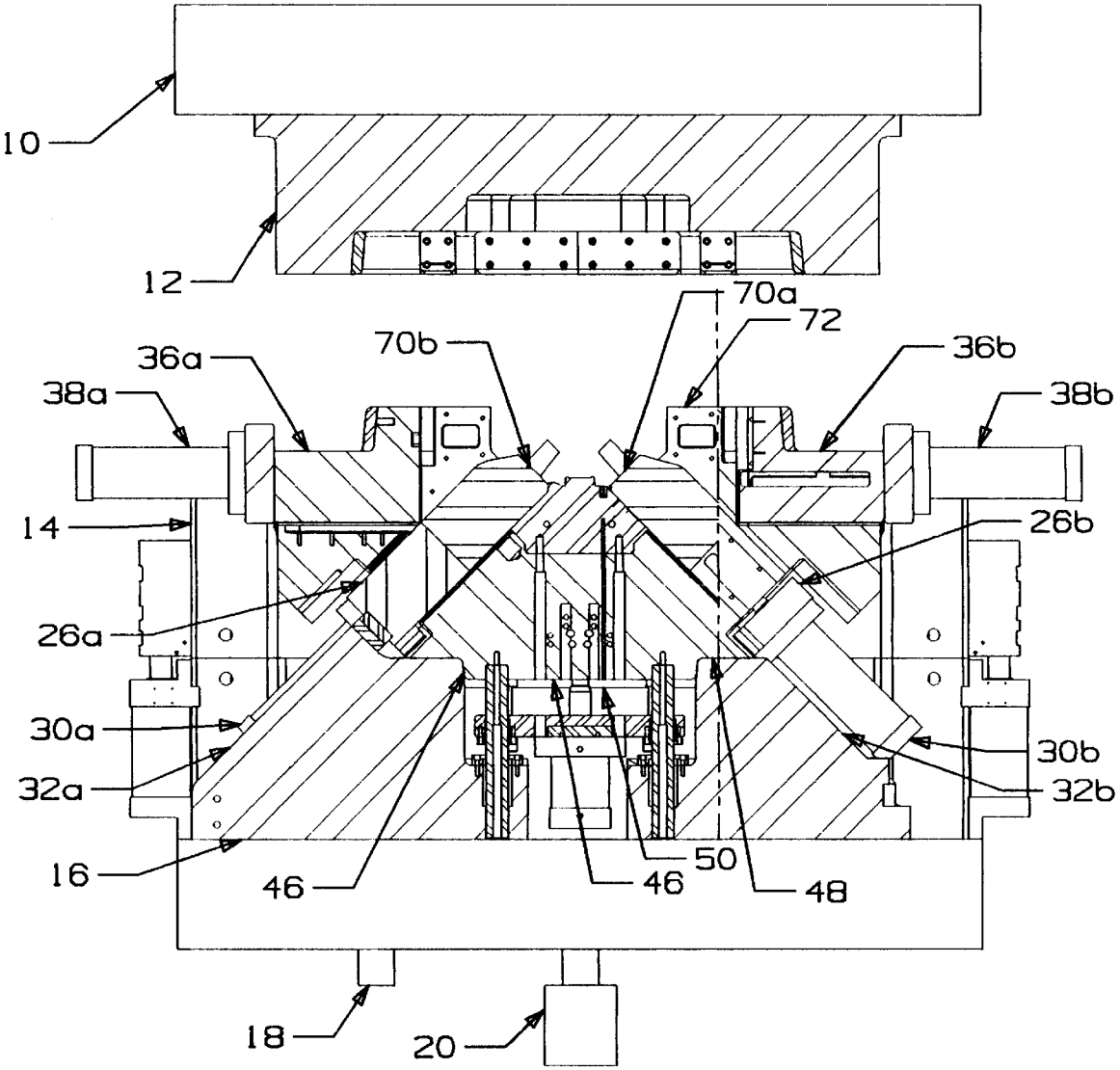
FIG. 3 is a top schematic view of the die casting machine of FIG. 1 showing in a partially closed position.
Figure 4:
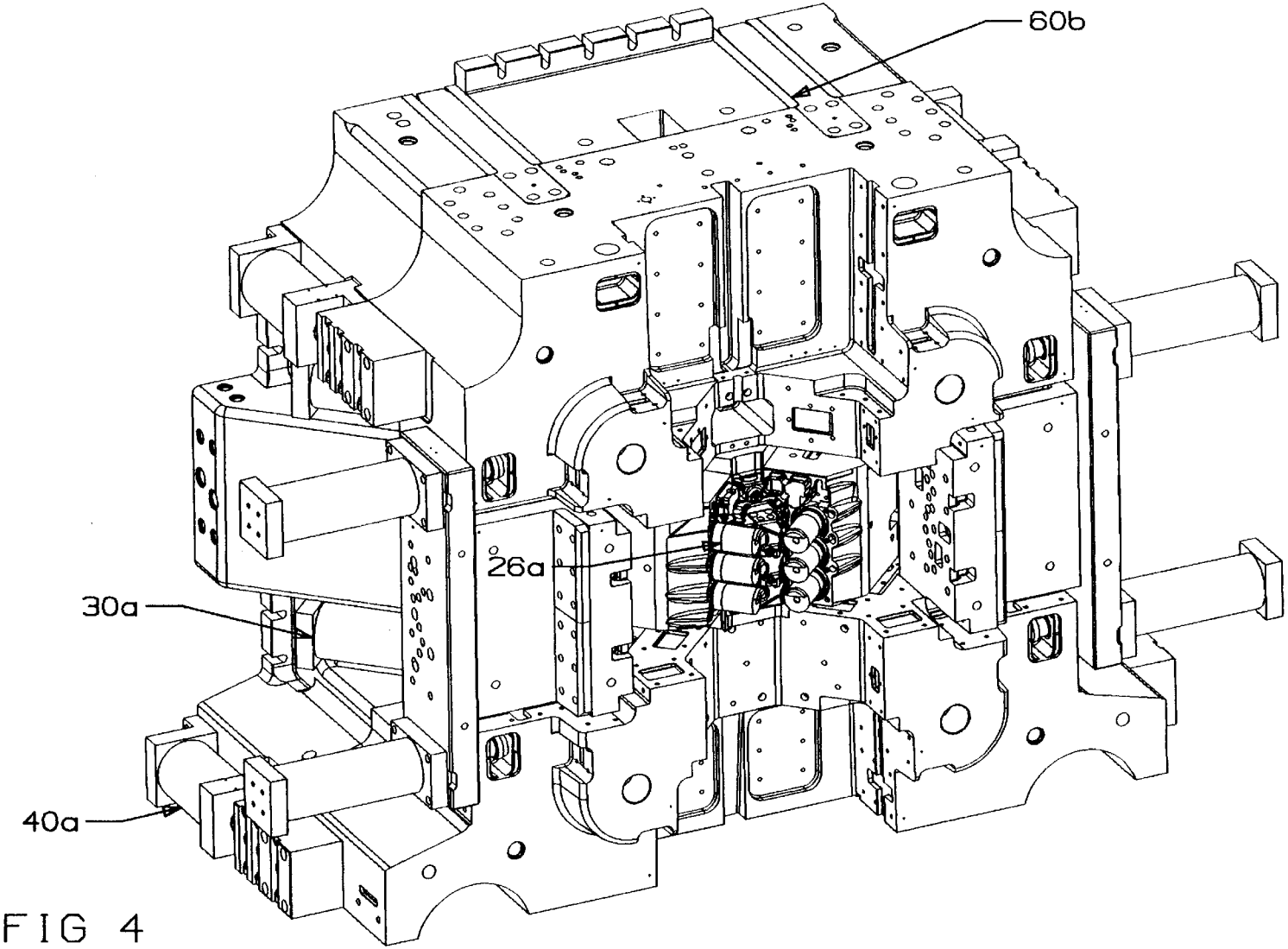
FIG. 4 is a perspective view of a portion of the die casting machine of FIG. 3.

With appropriate die core pieces 26*a*, 26*b* in place in machine 10, cylinders 30*a* and 30*b* may then extend to move the die core pieces 26*a*, 26*b* to their extended position. Next hydraulic cylinders 40*a* and 40*b* may retract to draw the ejector holder block 14 rearwardly into abutment with the ejection box 16. This position of the machine 10 is illustrated in FIG. 3. Turning to FIG. 3, it will be noted that with the ejector holder block abutting the ejection box, the male surface 46 of the ejector holder block mates with the female surface 50 of the ejection box. This precisely locates the ejector holder block with respect to the ejection box. Slots 32*a* and 32*b* have a sufficient width so that as the ejector holder block 14 is drawn toward the ejection box 16, the ejector holder block does not interfere with the cylinders 30*a* and 30*b*.

When the die core pieces 26*a*, and 26*b* are moved to their extended position, the rearward end of each die core piece sits flush with the rear surface 46 of the ejector holder block. Consequently, when the ejector holder block is drawn into abutment with the ejection box, the forward surface 48 of the ejection box acts as a backstop for the die core pieces 26*a*, 26*b* thereby locking them in their extended position. In the extended position, the die cavity forming ends 70*a*, 70*b* of die core pieces 26*a*, 26*b*, respectively, extend from the forward face 72 of the ejector holder block 14 such that these ends are accessible.

In forming an automotive cylinder block, ends 70*a*, 70*b* are used to form the cylinder heads of the block. These cylinder heads require a steel sleeve. Once the die core pieces 26*a*, 26*b* are in their extended position, these steel sleeves may be fitted over ends 70*a*, 70*b*. The fitting of the sleeves is made more difficult by reason of the fact that ends 70*a* and 70*b* cannot be formed with round edges which could accommodate small misalignments during fitting since the edges of ends 70*a*, 70*b* are important in forming a mould of precise dimensions. Consequently, in typical die casting machines, these steel sleeves are fitted to the ends of the die core pieces by human operators. With the subject machine, it is possible to precisely spatially locate ends 70*a*, 70*b* so as to allow for robotic placement. In this regard, it is first noted that drawing the ejector holder block into abutment with the ejection box, such that surf aces 46 and 50 mate, precisely locates the ejector holder block with respect to the ejection box. Moreover, by drawing the ejector holder block into mating abutment with the ejection box prior to moving the two mated parts forwardly into abutment with the station die half 12, wear on the mating surfaces is minimized so that the ejector holder block may continue to be precisely located with respect to the ejection block over time. Additionally, die core pieces 26*a*, 26*b* may be extended to a precise position with respect to the ejector holder block by applying a static retracting force on the die core pieces by way of cylinders 30*a*, 30*b* to ensure the die core pieces are in firm abutment with the forward surface 48 of the ejection box 16. Further, cylinder 20, in its retracted position, precisely locates ejection box 16 by retracting the ejection box into abutment with stop block 18 and maintaining a firm abutment with a constant static pressure in the cylinder 20. Given a precise spatial location of ends 70*a*, 70*b*, the steel sleeves may be fitted to ends 70*a*, 70*b* by a robot without the need of any precise vision locating system. It is also noted that by fitting the sleeves to the ends 70*a*, 70*b* after the ejector holder block has been drawn rearwardly into abutment with the ejection box, the space between the ejector holder block 14 and the stationary die half 12 is maximized which gives a robot more working room. Utilising a robot rather than a human operator for steel sleeve placement increases the speed of the moulding operation.

Figure 5:
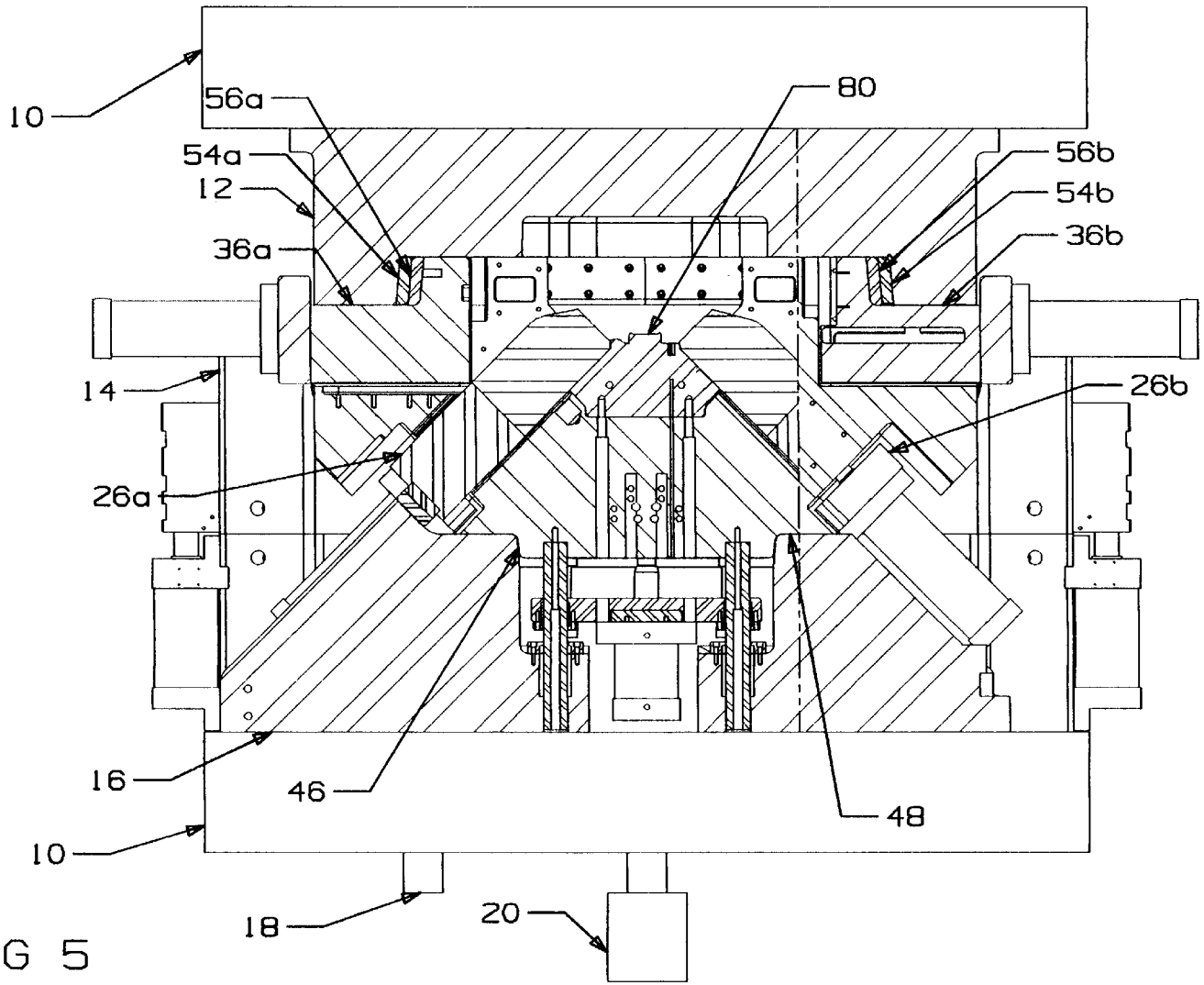
FIG. 5 is a top schematic view of the die casting machine of FIG. 1 showing in a closed position.

After these sleeves are fitted to the ends 70*a*, 70*b* of die core pieces 26*a*, 26*b*, the robot may move out of the way and cylinders 38*a* and 38*b* may extend die core pieces 36*a*, 36*b* to their extended position. Next cylinder 20 may be actuated to push the ejection box 16 and the mated ejector holder block 14 toward stationary die half 12 to a closed position. FIG. 5 illustrates the die casting machine 10 in its closed position. Turning to FIG. 5, in the closed position, the ejector holder block 14 abuts the stationary die half 12 with the notches 54*a*, 54*b* of die core pieces 36*a*, 36*b* matingly receiving the bulbs 56*a*, 56*b* of the stationary die half. In the closed position, the die casting machine 10 defines a die cavity 80. Molten metal may be injected into the die cavity 80 with a force which may range between 500,000 and one million pounds. The forward surface 48 of ejection box 16, by abutting the rearward surface of the die core pieces 26*a*, 26*b*, prevents the die core pieces from being blown out of the mould cavity 80 during injection. After the molten metal has solidified, the die casting machine 10 may be returned to its opened position of FIG. 1 and, ejector pins (not shown) of the ejector holder block may be extended to push the moulded product from the ejector holder block. The operation of the die may then be repeated.

Any of the hydraulic cylinders described in conjunction with machine 10 may be replaced by another linear actuator, such as a linear motor or a rotary motor terminating in a pinion engaging a rack.

While cylinders 30*a*, 30*b* have been described as extending through slots 32*a*, 32*b* in the ejection box 16, these cylinders could be positioned outside of the ejection box if another manner of locking the die core pieces in their extended position (such as locking wedges) were provided.

While exemplary die casting machine 10 is adapted to cast V-6 automobile engine blocks, it will be obvious to one skilled in the art that the principles described may be applied to die casting machines for casting other parts.

Other modifications will be apparent to those skilled in the art and, therefore, the invention is defined in the claims.

What is claimed is:

1. A mold for a die casting machine comprising:

a stationary die half;

an ejector holder block mounted for movement forwardly toward and rearwardly away from said stationary die half such that said ejector holder block may be moved forwardly to a closed position forming, with said stationary die half, a die cavity;

at least one die core piece slidably mounted in the ejector holder block for movement in a direction making an acute angle to the direction of movement of the ejector holder block between an extended position and a retracted position such that when said ejector holder block is in said closed position and said at least one die core piece is in said extended position, said die cavity is further defined;

a moveable ejection box mounted rearwardly of said ejector holder block for movement forwardly toward and rearwardly away from said stationary die half;

a rearward face of said ejector holder block and a forward face of said ejection box having complementary male and female locating surfaces for precisely locating said ejector holder block with respect to said ejection box when said ejector holder block is in abutment with said ejection box;

an actuator for moving said ejector holder block rearwardly into abutment with said ejection box prior to movement of said ejection box forwardly toward said stationary die half.

2. The mold of claim 1 wherein said forward face of said moveable ejection box has a surface for abutting a rear surface of said at least one die core piece when said moveable ejector holder block is in abutment with said ejection box and said at least one die core piece is in said extended position in order to lock said at least one die core piece in said extended position.

3. The mold of claim 2 including, for each of said at least one die core piece, an actuator for moving each said die core piece between said extended position and said retracted position.

4. The mold of claim 3 wherein said complementary male and female locating surfaces comprise a tapered protrusion on one of said ejector holding block and said ejection box and a complementary tapered opening in the other of said ejector holding block and said ejection box.

5. A die casting machine comprising:

a stationary die half;

an ejector holder block mounted for movement forwardly toward and rearwardly away from said stationary die half such that said ejector holder block may be moved forwardly to a closed position forming, with said stationary die half, a die cavity;

at least one die core piece slidably mounted in the ejector holder block for movement in a direction making an acute angle to the direction of movement of the ejector holder block between an extended position and a retracted position such that when said ejector holder block is in said closed position and said at least one die core piece is in said extended position, said die cavity is further defined;

a moveable ejection box mounted rearwardly of said ejector holder block for movement forwardly toward and rearwardly away from said stationary die half;

an actuator for moving said ejector holder block into abutment with said ejection box and for moving said ejector holder block away from said ejection box;

a rearward face of said ejector holder block and a forward face of said ejection box having complementary male and female locating surfaces for precisely locating said ejector holder block with respect to said ejection box when said ejector holder block is in abutment with said ejection box;

a die cast machine actuator for moving said ejection box toward and away from said stationary die half.

6. The die casting machine of claim 5 wherein said forward face of said moveable ejection box has a surface for abutting a rear surface of said at least one die core piece when said ejector holder block is in abutment with said ejection box and said at least one die core piece is in said extended position in order to lock said at least one die core piece in said extended position.

7. The die casting machine of claim 6 including, for each of said at least one die core piece, an actuator for moving each said die core piece between said extended position and said retracted position.

8. The die casting machine of claim 7 wherein said actuator for moving said ejector holder block toward or away from said ejection box acts between said ejector holder block and said ejection box.

9. The die casting machine of claim 8 wherein said actuator for moving said ejector holder block toward or away from said ejection box comprises a double acting hydraulic cylinder.

10. The die casting machine of claim 9 wherein said complementary male and female locating surfaces comprise a tapered protrusion on one of said ejector holding block and said ejection box and a complementary tapered opening in the other of said ejector holding block and said ejection box.

11. A method for forming a die cavity, comprising the steps of:

for each of at least one die core piece received by an ejector holder block at an acute angle to a first direction, moving said each die core piece to an extended position;

moving said ejector holder block, in said first direction, toward an ejection box such that complementary male and female surfaces on said ejector holder block and said ejection box mate to precisely locate said ejector holder block with respect to said ejection box;

moving said ejector holder block and said mated ejection box in a second direction opposite said first direction toward a stationary die half to a die closed position whereat said stationary die half, said ejector holder block and said at least one die core piece form a die cavity.

12. The method of claim 11 including the step of locking said at least one die core piece in said extended position simultaneously with mating said ejector holder block with said ejection box.

* * * * *